US006137381A

United States Patent [19]

Remillard et al.

[11] Patent Number: 6,137,381

[45] **Date of Patent: *Oct. 24, 2000**

[54] APERTURE HAVING FIRST AND SECOND SLOTS FOR COUPLING SPLIT-RING RESONATORS

[75] Inventors: Stephen K. Remillard; Amr Abdelmonem; Mostafa A. Beik, all of Arlington Heights, Ill.

[73] Assignee: Illinois Superconductor Corporation, Mount Prospect, Ill.

[ * ] Notice: This patent is subject to a terminal disclaimer.

[21] Appl. No.: 09/298,253

[22] Filed: Apr. 22, 1999

Related U.S. Application Data

[63] Continuation of application No. 08/716,108, Sep. 19, 1996, Pat. No. 5,909,159.

[51] Int. Cl.[7] ..... H01P 1/20

[52] U.S. Cl. ..... 333/202; 333/219; 333/230

[58] Field of Search ..... 333/202, 212, 333/219, 219.1, 227, 230

[56] References Cited

U.S. PATENT DOCUMENTS

| | | | |
|---|---|---|---|
| 3,697,898 | 10/1972 | Blachier et al. | 333/21 A |
| 3,969,692 | 7/1976 | Williams et al. | 333/212 |
| 4,060,779 | 11/1977 | Atia et al. | 333/212 |
| 4,135,133 | 1/1979 | Mok | 333/209 |
| 4,180,787 | 12/1979 | Pfitzenmaier | 333/212 |
| 4,453,146 | 6/1984 | Fiedziuszko | 333/212 |
| 4,489,293 | 12/1984 | Fiedziuszko | 333/202 |
| 4,540,955 | 9/1985 | Fiedziuszko | 331/107 DP |
| 4,652,843 | 3/1987 | Tang et al. | 333/212 |
| 4,652,844 | 3/1987 | Brambilla | 333/212 |
| 4,675,630 | 6/1987 | Tang et al. | 333/208 |
| 4,721,933 | 1/1988 | Schwartz et al. | 333/212 |
| 5,083,102 | 1/1992 | Zaki | 333/212 |
| 5,200,721 | 4/1993 | Mansour | 333/202 |
| 5,268,659 | 12/1993 | Zaki et al. | 333/209 |
| 5,349,316 | 9/1994 | Sterns | 333/208 |
| 5,484,764 | 1/1996 | Fiediuszko et al. | 505/210 |
| 5,498,771 | 3/1996 | Mansour et al. | 505/210 |
| 5,515,016 | 5/1996 | Holme et al. | 333/202 |
| 5,616,540 | 4/1997 | Lithgow et al. | 333/202 X |
| 5,629,266 | 5/1997 | Lithgow et al. | 333/202 X |
| 5,909,159 | 6/1999 | Remillard et al. | 333/202 |

FOREIGN PATENT DOCUMENTS

| | | | |
|---|---|---|---|
| 0 188 367 | 1/1986 | European Pat. Off. . | |
| 23 27 912 | 12/1974 | Germany . | |
| 1 029 936 | 5/1966 | United Kingdom . | |
| 1 160 858 | 6/1969 | United Kingdom . | |
| 2269704A | 2/1994 | United Kingdom | 333/212 |
| WO 96/17398 | 6/1996 | WIPO . | |

OTHER PUBLICATIONS

Accatino and Bertin, "Design of Coupling Irises Between Circular Cavities by Modal Analysis," *IEEE Transactions on Microwave Theory and Techinques*, vol. 42, No. 7, pp. 1307–1313 (Jul. 1994).

Baillargeat, Verdeyme, and Guillon, "Elliptic Filter Rigorous Design and Modelling Applying The Finite Element Method," *IEEE MTT–S Digest*, pp. 1195–1198 (1995).

Kajfez and Guillon, *Dielectric Resonators*, pp. 418–421.

Yao, et al., "Generalized Dual–Plane Multicoupled Line Filters," *IEEE Transactions on Microwave Theory and Techniques*, vol. 41, No. 12, pp. 2182–2189 (Dec. 1993).

PCT International Search Report dated Sep. 12, 1997.

G.L. Ragan: "Microwave Transmission Circuits", 1948, McGraw–Hill, New York XP002047563.

*Primary Examiner*—Robert Pascal
*Assistant Examiner*—Barbara Summons
*Attorney, Agent, or Firm*—Marshall, O'Toole, Gerstein, Murray & Borun

[57] ABSTRACT

An electromagnetic filter includes a filter housing containing a first resonant cavity and a second resonant cavity. Resonators are disposed within each of the cavities. The electromagnetic filter also includes a cavity wall separating the first resonant cavity and the second resonant cavity. The cavity wall includes a T-shaped aperture to achieve magnetic coupling between the first resonant cavity and the second resonant cavity.

7 Claims, 5 Drawing Sheets

APERTURE HAVING FIRST AND SECOND SLOTS FOR COUPLING SPLIT-RING RESONATORS

This is a continuation of U.S. application Ser. No. 08/716,108, which was filed on Sep. 19, 1996, now U.S. Pat. No. 5,909,159.

FIELD OF THE INVENTION

The present invention relates generally to electromagnetic filters and, more particularly, to configurations of such filters for attaining appropriate electromagnetic coupling between resonant cavities of those filters.

BACKGROUND ART

In designing electromagnetic filters having multiple resonant elements, it is desirable to control the strength and nature of coupling between adjacent resonant elements in the interest of determining particular coupling bandwidths for the filter. The strength of the coupling is represented by the magnitude of the coupling coefficient k, which is defined as follows:

$$k=k_H-k_E,$$

wherein $k_H$ and $k_E$ represent the magnetic and electric coupling coefficients, respectively. The extent to which the respective magnetic and electric fields generated by each resonant element interact determines the magnitudes of $k_H$ and $k_E$, respectively. If k is positive, the coupling has a magnetic nature, while if k is negative, the coupling has an electric nature.

Typical bandpass filters, for example, include multiple resonant elements separated by interior walls of a filter housing where each interior wall has an aperture to permit a certain amount of coupling between adjacent resonant elements. The aperture in the interior wall separating the adjacent resonant elements allows a limited amount of interaction between the electromagnetic fields generated by the adjacent resonant elements. If no interior wall separates the resonant elements, the strength and nature of the coupling is determined merely by coupling cancellation, thereby providing limited design flexibility.

As shown in FIGS. 1A and 1B, a portion of a prior bandpass filter designed to achieve magnetic coupling includes a filter housing 10 having a cover 12, a first side wall 14, a second side wall 16, a bottom wall 18, a back wall 20, and a front wall 22 (FIG. 1B). The portion of the bandpass filter further includes two resonant cavities 24, 26 defined by an interior wall 28. The two resonant cavities 24, 26 each include a split-ring resonator 30 mounted on a face of the cover 12 by a mounting mechanism 32. Assuming that some signal source (not shown) provides a signal to one of the two resonant cavities 24, 26, coupling between the two resonant cavities 24, 26 would occur through a slot aperture 34 (FIG. 1B) disposed in the interior wall 28 as shown. The slot aperture 34 does not, however, provide a sufficient amount of magnetic coupling for some filter specifications.

SUMMARY OF THE INVENTION

In accordance with one aspect of the present invention, an electromagnetic filter includes a filter housing containing a first resonant cavity and a second resonant cavity. The filter further includes a cavity wall separating the first resonant cavity and the second resonant cavity. The electromagnetic filter still further includes a T-shaped aperture disposed in the cavity wall.

In a preferred embodiment of the present invention, the electromagnetic filter further includes a first split-ring resonator disposed in the first resonant cavity and a second split-ring resonator disposed in the second resonant cavity, where the first split-ring resonator and the second split-ring resonator each have a gap. The cavity wall may be defined by a first edge, a second edge, a third edge and a fourth edge that together form a rectangular cross-sectional shape. The first edge is opposite the fourth edge and the second edge is opposite the third edge. The gap of each split-ring resonator may be disposed near the first edge and approximately equally distant from the second edge and the third edge. The T-shaped aperture may include a first slot disposed substantially parallel to and substantially equally distant from the second edge and the third edge. The T-shaped aperture may include a second slot disposed substantially parallel to and substantially near the fourth edge.

The second slot may extend along the fourth edge of the cavity wall and may extend to both the second edge and the third edge. The first slot may extend from the first edge to the fourth edge. The first split-ring resonator and the second split-ring resonator may be toroidally-shaped and the cavity wall may have a square shape.

In accordance with another aspect of the present invention, an electromagnetic filter includes a filter housing containing a first resonant cavity and a second resonant cavity. The electromagnetic filter further includes a cavity wall separating the first resonant cavity and the second resonant cavity. The cavity wall is defined by a first edge, a second edge, a third edge and a fourth edge that together form a rectangular cross-sectional shape. The first edge is opposite the fourth edge and the second edge is opposite the third edge. A first slot aperture in the cavity wall is disposed substantially parallel to and substantially equally distant from the second edge and the third edge and a second slot aperture in the cavity wall is disposed substantially parallel to and substantially near the fourth edge.

In accordance with yet another aspect of the present invention, an electromagnetic filter includes a filter housing containing a first resonant cavity and a second resonant cavity. The electromagnetic filter further includes a cavity wall separating the first resonant cavity and the second resonant cavity. The cavity wall is defined by a first edge, a second edge, a third edge and a fourth edge that together form a rectangular cross-sectional shape. The first edge is opposite the fourth edge and the second edge is to opposite the third edge. A first split-ring resonator is disposed in the first resonant cavity. A second split-ring resonator is disposed in the second resonant cavity. The cavity wall includes an aperture having a first slot disposed substantially parallel to and substantially equally distant from the second edge and the third edge and further having a second slot disposed substantially parallel to and substantially near the fourth edge. The first split-ring resonator and the second split-ring resonator each have a gap and the gap of each split-ring resonator is disposed near the first edge and approximately equally distant from the second edge and the third edge.

Other features and advantages are inherent in the electromagnetic filter claimed and disclosed or will become apparent to those skilled in the art from the following detailed description in conjunction with the accompanying drawing.

DETAILED DESCRIPTION OF THE PREFERRED EMBODIMENT

Figure 1:
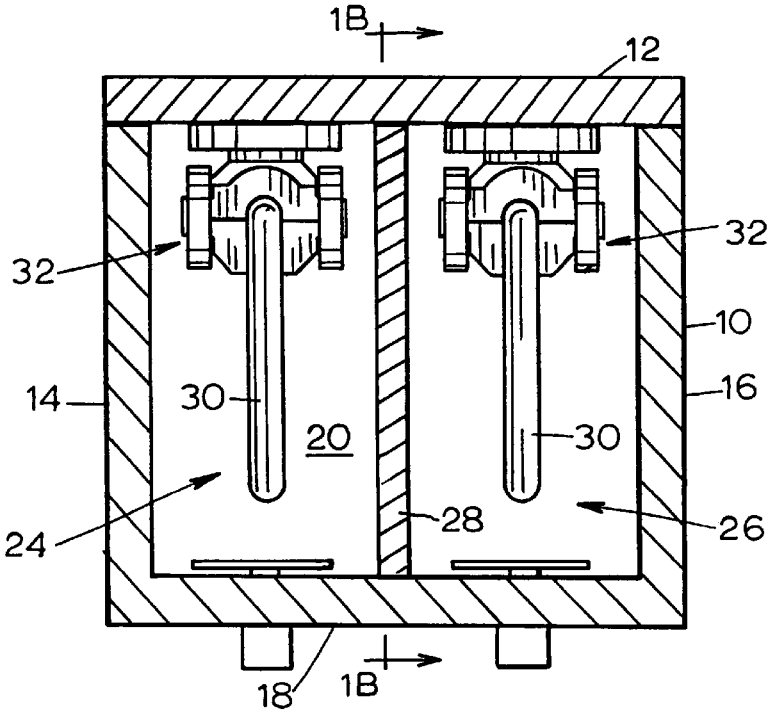
FIG. 1 PRIOR ART
FIG. 1A is a cross-sectional view of a prior art electromagnetic filter taken along the lines 1A—1A of FIG. 1B.
FIG. 1B is a cross-sectional view of the prior art electromagnetic filter of FIG. 1A taken along the lines 1B—1B of FIG. 1A.
Figure 1B:
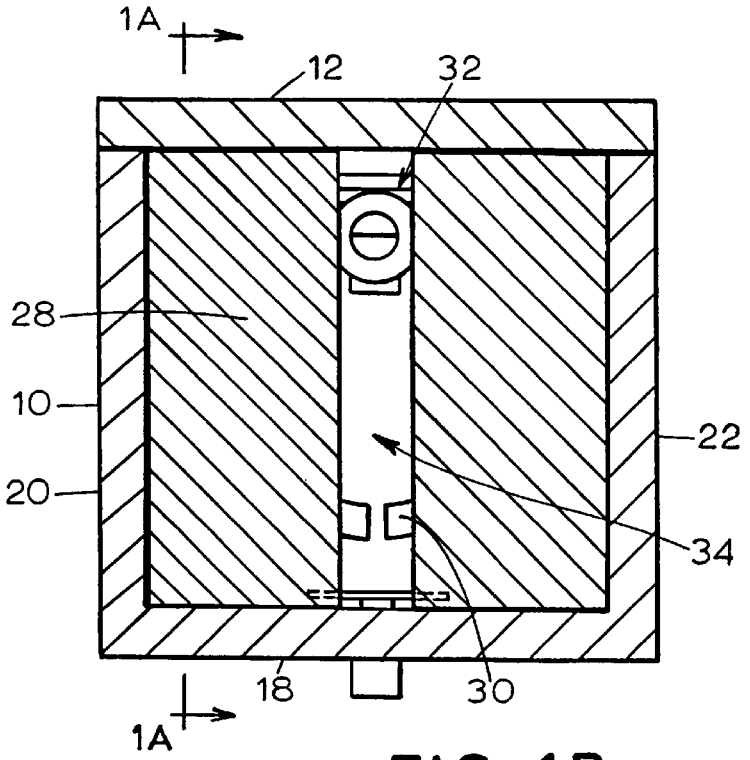
FIG. 1B PRIOR ART
Figure 2:
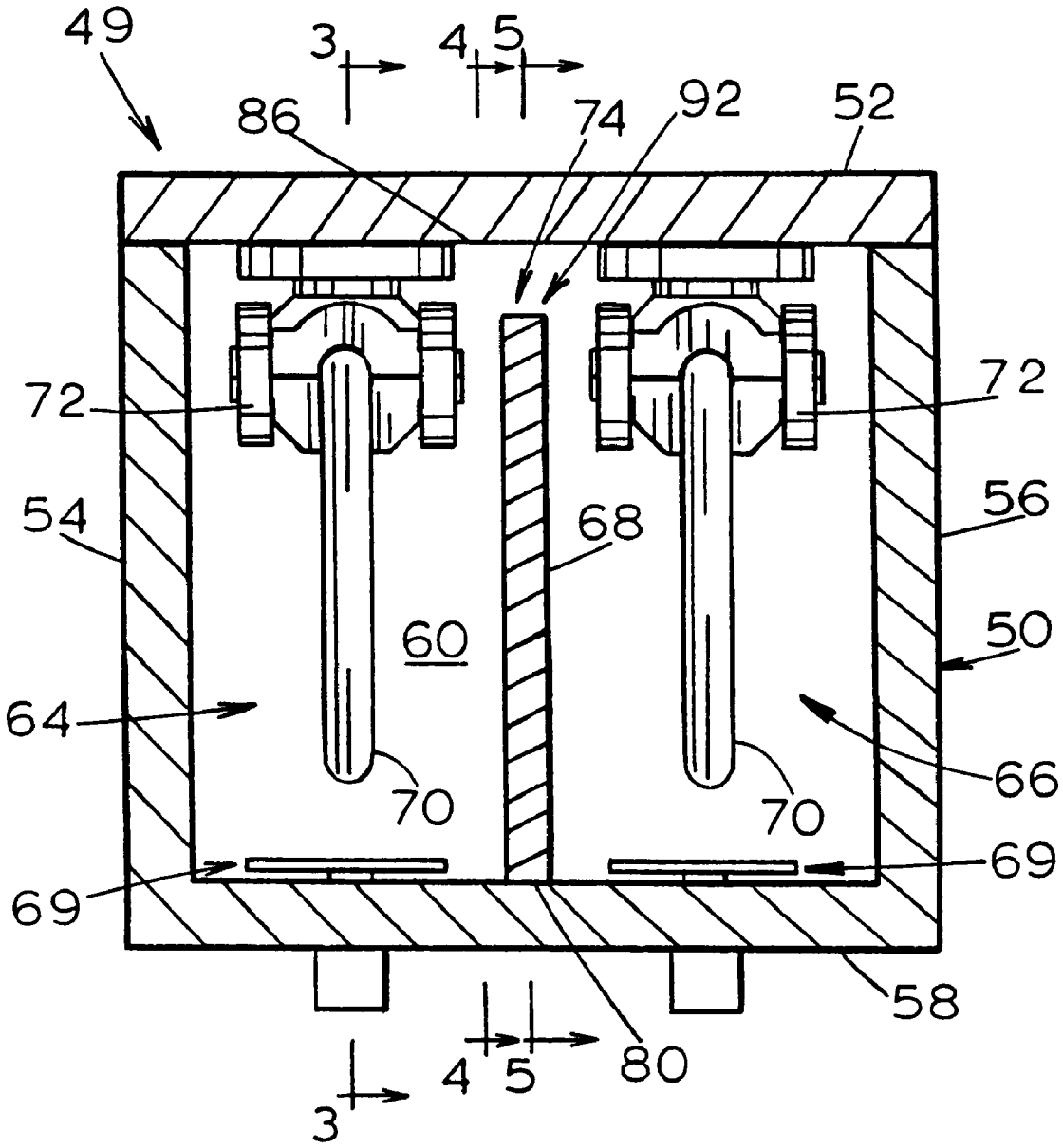
FIG. 2 is a cross-sectional view of an electromagnetic filter according to the present invention taken along the lines 2—2 of FIG. 3.
Figure 3:
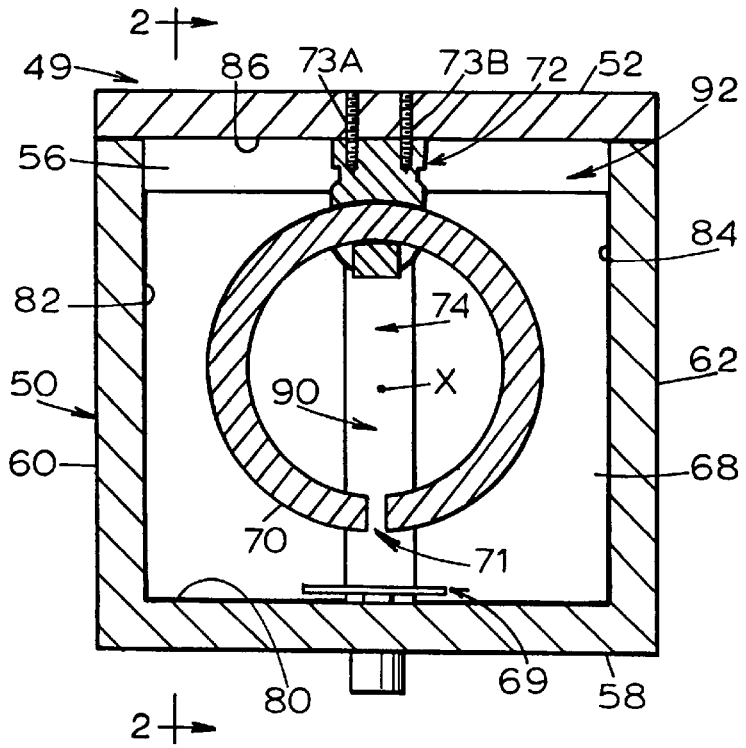
FIG. 3 is a cross-sectional view of the electromagnetic filter of FIG. 2 taken along the lines 3—3 of FIG. 2.
Figure 4:
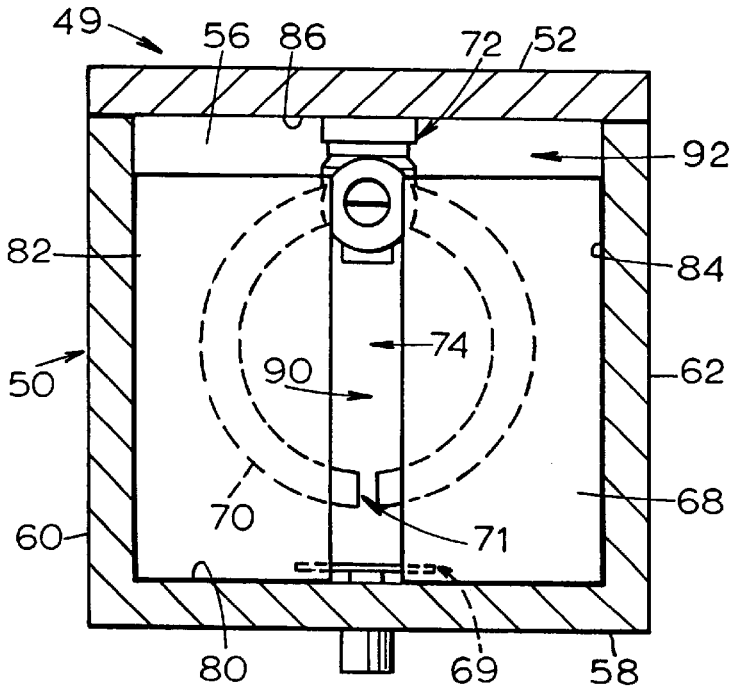
FIG. 4 is a cross-sectional view of the electromagnetic filter of FIG. 2 taken along the lines 4—4 of FIG. 2.
Figure 5:
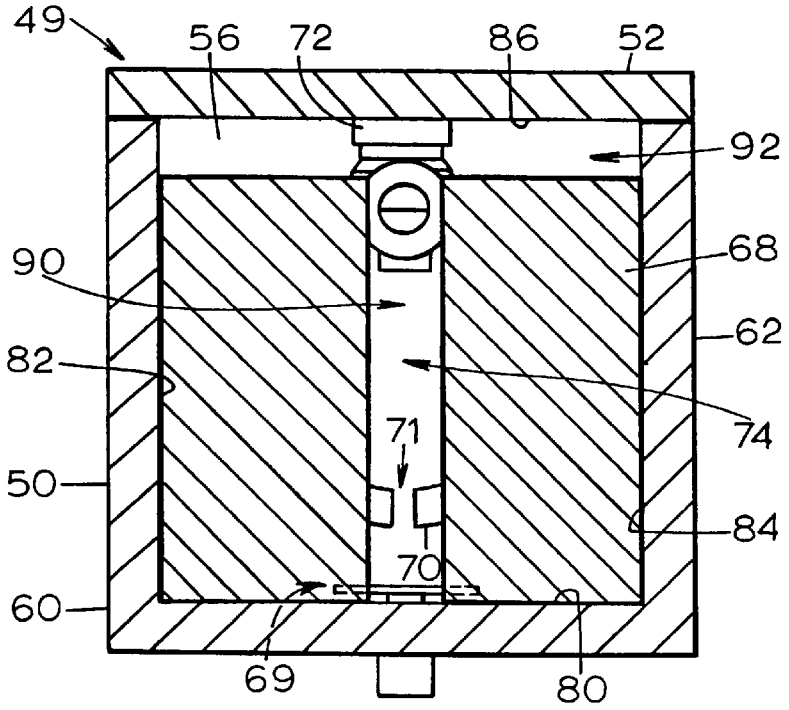
FIG. 5 is a cross-sectional view of the electromagnetic filter of FIG. 2 taken along the lines 5—5 of FIG. 2.

Referring initially to FIGS. 2–5, an electromagnetic filter 49 according to the present invention includes a filter housing indicated generally at 50 having a cover 52, a first side wall 54, a second side wall 56, a bottom wall 58, a back wall 60, and a front wall 62 (FIGS. 3–5). The filter housing 50 contains a first resonant cavity indicated generally at 64 (FIG. 2) adjacent a second resonant cavity indicated generally at 66 (FIG. 2) separated by an interior cavity wall 68. The first resonant cavity 64 and the second resonant cavity 66 each include a tuning mechanism 69 and a split-ring resonator 70 having a gap 71 (FIGS. 3–5). Each split-ring resonator 70 is substantially toroidally-shaped and is symmetric about an axis X (FIG. 3) with the exception of the gap 71. Each split-ring resonator 70 is mounted on a face of the cover 52 by a mounting mechanism 72 which may be secured to the cover 52 by a pair of screws 73A, 73B (FIG. 3).

In operation, a signal source (not shown) provides a signal to a first coupling mechanism (not shown) disposed in a wall of the filter housing 50 to couple the signal to either the first resonant cavity 64 or the second resonant cavity 66. Coupling between the first resonant cavity 64 and the second resonant cavity 66 then occurs through an aperture 74 disposed in the interior cavity wall 68. A second coupling mechanism (not shown) would be placed in the cavity not having the first coupling mechanism for coupling a filtered signal out of the filter.

As best seen in FIG. 5, the interior cavity wall 68 has a rectangular cross-section defined by a bottom edge 80, a first side edge 82, a second side edge 84 and a top edge 86. Each split-ring resonator 70 is oriented in the respective resonant cavity 64, 66 such that the gap 71 is disposed near the bottom edge 80 and approximately equally distant from the first side edge 82 and the second side edge 84. Further, the rectangular cross-section of the interior cavity wall 68 is preferably square-shaped.

The aperture 74 includes a first slot portion indicated generally at 90 and a second slot portion indicated generally at 92. The first slot portion 90 is disposed substantially parallel to and substantially equally distant from the first side edge 82 and the second side edge 84. The second slot portion 92 is disposed substantially parallel to and near the top edge 86. The precise locations and dimensions of the first slot portion 90 and the second slot portion 92 of the aperture 74 are subject to slight variation due to the manufacturing process and through design modification, as will be explained hereinafter in more detail.

As shown in FIGS. 3–5, the first slot portion 90 of the aperture 74 may extend from the bottom edge 80 of the interior cavity wall 68 to the top edge 86 of the interior cavity wall 68. Furthermore, the second slot portion 92 of the aperture 74 may extend from the first side edge 82 to the second side edge 84 and also may be disposed along the top edge 86 of the cavity wall 68.

Figure 6:
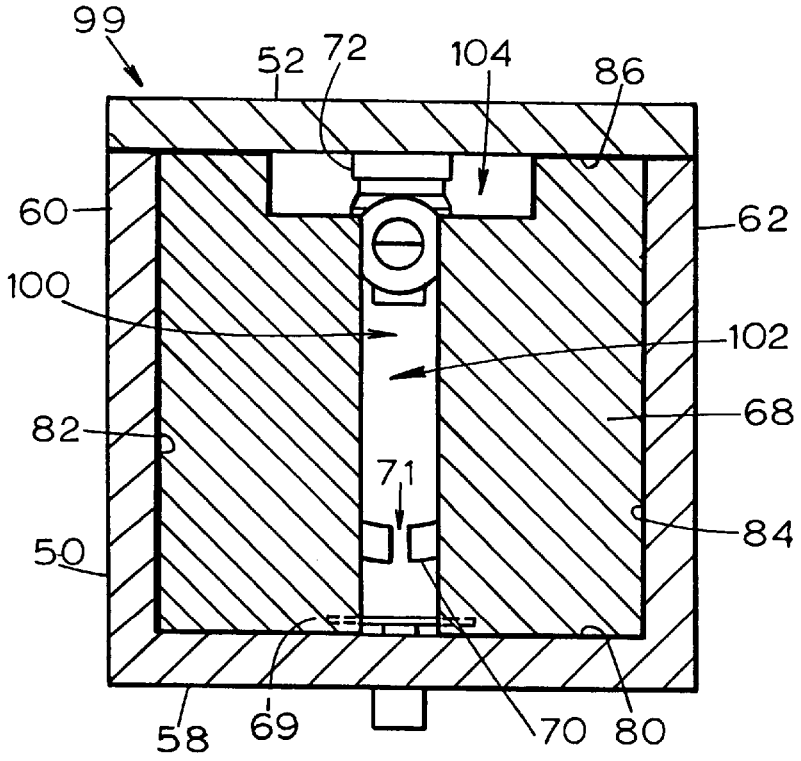
FIG. 6 is a view of another embodiment of an electromagnetic filter according to the present invention similar to the view of FIG. 5.

In an alternative electromagnetic filter 99 according to the present invention, however, the second slot portion 92 does not extend to both the first side edge 82 and the second side edge 84, but rather only to a certain extent along the top edge 86. As shown in FIG. 6, the interior cavity wall 68 has an aperture 100 including a first slot portion 102 and a second slot portion 104. Reducing the size of the second slot portion 104 of the aperture 100 adjusts the amount of coupling between the first resonant cavity 64 and the second resonant cavity 66. Other elements shown in FIG. 6 common to FIGS. 3–6 are assigned like reference numerals.

Figure 7:
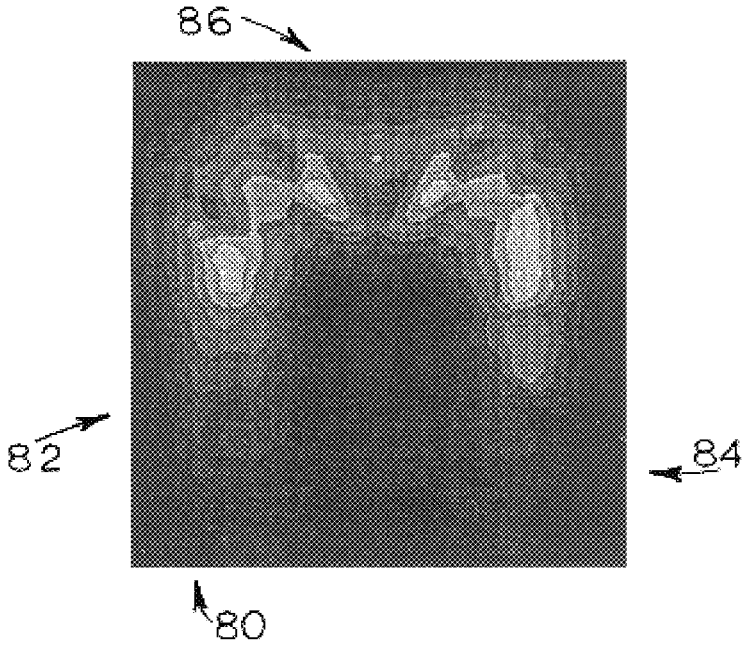
FIG. 7 is a half-tone image, computer-generated plot of a magnetic field magnitude distribution in a resonant cavity of an electromagnetic filter of the present invention.

In both embodiments shown in FIGS. 2–6, the first slot portion and the second slot portion meet to form a T-shaped aperture for attaining a certain amount of magnetic coupling between the first resonant cavity 64 and the second resonant cavity 66. The T-shaped aperture is desirable because of the distribution of the electromagnetic fields generated in the first resonant cavity 64 and the second resonant cavity 66. FIG. 7 shows the magnetic field, in the first resonant cavity 64 or the second resonant cavity 66, in the plane of line 4—4 of FIG. 2. As shown in FIG. 7, the magnetic field generated in either the first resonant cavity 64 or the second resonant cavity 66 has a magnitude distribution at or near the interior cavity wall 68 having areas of high intensity (lighter areas) closer to the top edge 86 (as opposed to the bottom edge 80) of the cavity wall 68. In other words, the magnetic field component is stronger away from the gap 71 of the split-ring resonator 70.

Figure 8:
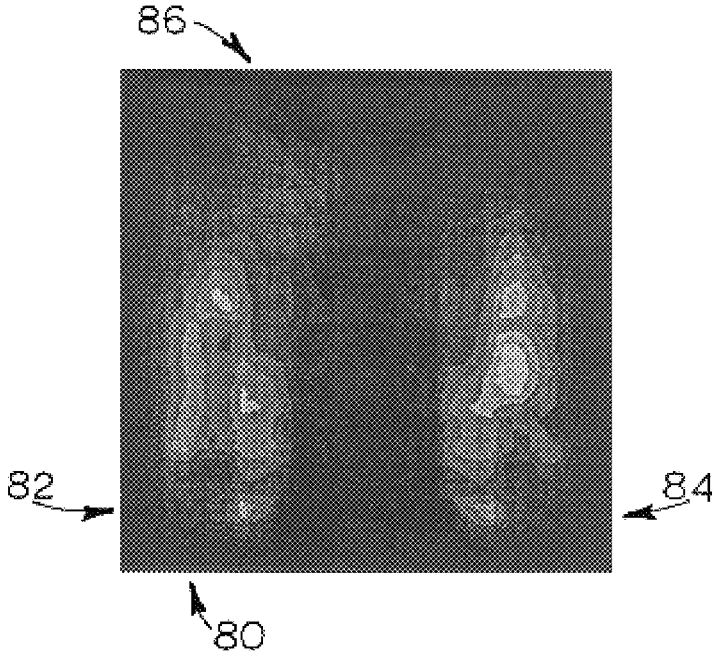
FIG. 8 is a half-tone image, computer-generated plot of an electric field magnitude distribution in a resonant cavity of an electromagnetic filter of the present invention.

FIG. 8 is a plot showing the intensity of the electric field component of the electromagnetic field taken in the same plane as shown for FIG. 7, i.e., at or near the interior cavity wall 68. The electric field, unlike the magnetic field, has two areas of high intensity disposed away from the top edge 86 and separated by a middle portion between the side edge 82 and the side edge 84 of the interior cavity wall 68. Furthermore, the electric field component has a relatively low intensity in the middle portion, as shown by the dark portion of FIG. 8.

To ensure a certain amount of magnetic coupling between the first resonant cavity 64 and the second resonant cavity 66, the aperture 74 (or 100) is disposed in the interior cavity wall 68 either (1) in areas where the magnetic field has a relatively high intensity and the electric field has either a low or medium intensity, or (2) simply in areas where the electric field has a relatively low intensity. Thus, knowledge of the magnetic and electric field magnitude distributions at or near the interior cavity wall 68 allows one to design an aperture with the appropriate dimensions and location to ensure sign purity for the coupling coefficient k. Once such areas have been approximately identified, the dimensions and the location of the aperture 74 (or 100) must be fine-tuned to achieve the appropriate amount of magnetic (or electric) coupling in order to set a particular coupling bandwidth.

It follows from the above discussion that minor modifications of the T-shaped apertures shown in FIGS. 3–6 could be made without resulting in modification of the amount of magnetic coupling. Furthermore, a particular minor change in location or dimension could be offset by an additional minor modification in location or dimension. Still further, the first slot portion 90 (or 102) and the second slot portion 92 (or 104) need not meet to form a T-shaped aperture if a slightly different amount of magnetic coupling is desired. For the same reason, the first slot aperture 90 (or 102) need not extend to the bottom edge 80 of the interior cavity wall 68.

Although the filter shown herein has only two cavities, filters may be designed having numerous cavities separated by cavity walls. In such an instance, the two cavities at the ends of the filter will have coupling mechanisms for coupling signals into or out of the filter. The interior walls separating such cavities would make use of the apertures described herein. Depending on the coupling bandwidths desired, each aperture may be identical or there may be differences in the location and dimensions of such apertures.

The foregoing detailed description has been given for clearness of understanding only, and no unnecessary limitations should be understood therefrom, as modifications would be obvious to those skilled in the art.

What is claimed is:

1. An electromagnetic filter comprising:

a filter housing containing a first resonant cavity and a second resonant cavity;

a first split-ring resonator disposed in the first resonant cavity;

a second split-ring resonator disposed in the second resonant cavity;

a cavity wall separating the first resonant cavity and the second resonant cavity; and an aperture disposed in the cavity wall;

the first and second split-ring resonators have a respective gap;

the aperture comprises a first slot aperture and a second slot aperture;

positioning of the respective gaps in the first and second resonant cavities influences a magnitude distribution of an electromagnetic field near the cavity wall; and the first and second slot apertures are positioned in accordance with the magnitude distribution to establish magnetic coupling between the first and second resonant cavities.

2. The electromagnetic filter of claim 1 wherein:

the magnitude distribution comprises an area of low electric field intensity; and the aperture is positioned in the area of low electric field intensity.

3. The electromagnetic filter of claim 1 wherein:

the magnitude distribution comprises an area of high magnetic field intensity; and the aperture is positioned in the area of high magnetic field intensity.

4. The electromagnetic filter of claim 1 wherein the first and second slot apertures compose a T-shape.

5. An electromagnetic filter comprising:

a filter housing containing a first resonant cavity and a second resonant cavity;

a first split-ring resonator disposed in the first resonant cavity;

a second split-ring resonator disposed in the second resonant cavity; and a cavity wall separating the first resonant cavity and the second resonant cavity and having a T-shaped aperture;

wherein the first split-ring resonator and the second split-ring resonator each have a respective gap aligned with a base portion of the T-shaped aperture.

6. The electromagnetic filter of claim 5 wherein the base portion of the T-shaped aperture is positioned in an area of low electric field intensity.

7. The electromagnetic filter of claim 5 wherein the T-shaped aperture has a top portion positioned in an area of high magnetic field intensity.

* * * * *

UNITED STATES PATENT AND TRADEMARK OFFICE

CERTIFICATE OF CORRECTION

PATENT NO. : 6,137,381

DATED : October 24, 2000

INVENTOR(S) : Remillard *et al.*

It is certified that an error appears in the above-identified patent and that said Letters Patent is hereby corrected as shown below:

Column 5, line 35, after "cavity wall", please insert the word -- wherein --.

Signed and Sealed this

Eighth Day of May, 2001

*Attest:*

Nicholas P. Godici

NICHOLAS P. GODICI

*Attesting Officer*

*Acting Director of the United States Patent and Trademark Office*